US006423891B1

(12) United States Patent
Zengerle

(10) Patent No.: US 6,423,891 B1
(45) Date of Patent: Jul. 23, 2002

(54) ILLUMINATED DRUMSTICK INCORPORATING COMPRESSION SPRING FOR ENSURING CONTINUOUS AND BIASING CONTACT

(76) Inventor: John A. Zengerle, 968 Parallel St., Fenton, MI (US) 48430

( * ) Notice: Subject to any disclaimer, the term of this patent is extended or adjusted under 35 U.S.C. 154(b) by 0 days.

(21) Appl. No.: 09/789,778

(22) Filed: Feb. 20, 2001

(51) Int. Cl.[7] ..... G10D 13/02
(52) U.S. Cl. ..... 84/422.4; 84/464 A; 84/464 R
(58) Field of Search ..... 84/422.4, 464 A, 84/464 R; 362/118

(56) References Cited

U.S. PATENT DOCUMENTS

| | | | | |
|---|---|---|---|---|
| 4,106,079 A | | 8/1978 | Drury | 362/34 |
| 4,202,241 A | | 5/1980 | Lucas | 84/422.4 |
| 4,226,163 A | | 10/1980 | Welcomer | 84/422.4 |
| 4,722,035 A | | 1/1988 | Rapisarda | 362/109 |
| 4,763,557 A | | 8/1988 | Donohoe | 84/422.4 |
| 5,503,056 A | * | 4/1996 | Evans | 84/422.4 |
| 6,145,993 A | | 11/2000 | Filippino | 362/102 |

* cited by examiner

*Primary Examiner*—Shih-Yung Hsieh
(74) *Attorney, Agent, or Firm*—Gifford, Krass, Groh, Sprinkle, Anderson & Citkowski, P.C.

(57) ABSTRACT

An illuminating drumstick having an elongated body with a hollowed interior extending substantially between a tip end and an open butt end. A threadably engageable end cap secures over the butt end. A power supply is contained within a housing axially inserted within the hollowed interior, the power supply including at least one battery having a positive terminal and a negative terminal. An illuminating light emitting diode is arranged at the tip end and communicates with the positive and negative terminals of the power supply. A first wire extends from the diode to the negative terminal and a second wire likewise extends from the diode to the positive terminal. An on/off circuit is activated by rotating the threaded end cap relative the body and to selectively open and close an electrical connection to the positive terminal. The circuit further includes a continuously biasing spring and an electrically communicable clip ring urged by the end cap in a first threaded direction against the positive terminal in a first "on" position. The spring decompresses from the positive terminal, and the end cap dis-communicates from and out of communication with the clip ring, in a second "off" position and upon rotation of the end cap in an opposite and unthreaded direction.

19 Claims, 2 Drawing Sheets

3
3
10
16
18
20
22
24
26
30
32
36
38
40
42
46
48
50
52
54
56
58
60
62
63
66
68
70
72
96

ILLUMINATED DRUMSTICK INCORPORATING COMPRESSION SPRING FOR ENSURING CONTINUOUS AND BIASING CONTACT

BACKGROUND OF THE INVENTION

1. Field of the Invention

The present invention relates generally to drumstick devices, such as including illuminated tips. More particularly, the present invention is directed to such a drumstick device exhibiting an LED illuminated tip and which further includes an improved compression spring structure for ensuring continuous and biasing contact of a closed circuit established by the illuminating structure in the drumstick during its use, as well as permitting old and worn out batteries to be easily replaced.

2. Description of the Prior Art

A first example of an illuminated drumstick device is illustrated in U.S. Pat. No. 4,226,163, issued to Welcomer, which teaches a drumstick having a tip, a shank and a cap. The tip includes a light emitting diode and electrical leads which connect the diode to a power source housed in a cavity separating the shank and the cap. Threading the cap onto the shank closes a circuit including the power source, an insulating washer, a conductive rivet, and terminals leading to the diode. In use, the threaded and metallic plug portion of the end cap is rotated to an advanced position, contacting the batteries and closing an electrical circuit and causing the light source located in the tip to be illuminated.

A perceived shortcoming of the Welcomer device is the failure to teach or suggest any type of biasing means for ensuring continuous electrical contact between the batteries and the positive and negative terminals of the circuit. It is noted that Welcomer teaches, at column 2, lines 52–55, that a spring could be used to bias the batteries out of contact with one another or with the conductive rivet and that the spring could further be conductive or not, depending on its method of use. Welcomer however does not teach, suggest or intimate as to how such a spring would be configured, located or biased and further does not teach the use of such a spring to maintain engagement, as opposed to non-engagement, of a closed circuit.

U.S. Pat. No. 4,722,035, issued to Rapisarda, teaches a drumstick with light emitting diode powered by batteries. The drumstick includes a switch using a flexible metal strap over a resilient pad affixed to one end of the batteries. Additionally, batteries may be connected by a thin flexible strap, and the light emitting diode is rectangular in shape and securely held in a channel at the tip of the drumstick. An elongate, threaded and rotatable thumbscrew extends within one end of the drumstick and, upon being advanced to forward-most position, a shaft end of the screw makes electrical contact with the casing of the rearward located battery which, in turn, is electrically connected to the forward located battery.

A detailed review of Rapisarda again suggests that no effective means are disclosed for ensuring that electrical communication is maintained between the batteries and the circuitry, particularly in view of the physical movements which the drumsticks undergo in use. It is noted that Rapisarda teaches, at column 3, lines 7–12, that the flexible metal strap may be connected to the casing of one battery and wrapped around a collector pin of an adjacently located battery and that the batteries may further be secured to the internal cavity by an adhesive such as a poly vinyl acetate glue.

Although effective in limited instances to maintain a degree of continuous electrical contact in the circuitry, the device of Rapisarda teaches against the ability to replace worn batteries (due again to the fact that the batteries are disclosed to be permanently and adhesively affixed to the interior cylindrical wall of the housing). Also, the failure to provide any effective type of continuous biasing between the shaft end of the rotatable thumb screw and the adjacent cathode end of the rear-most battery may still result in breaks to the electrical contact established therebetween. This is due in part due to the tendency of the freely rotatable and threaded thumbscrew to tend to rotate in a disengaging direction during normal use of the drumstick and further due to the absence of any additional structure to ensure continuous electrical engagement.

An additional disadvantage noted by the device of Rapisarda, and in particular its rearwardly extending thumbscrew, is that it does not permit the drummer to strike the drum surface with the rearward, or fat end, of the drumstick and so as to create additional audio and visual effects. The existence of the rotatable switch tab portion of the thumbscrew would, rather, cause extensive damage to the drum, and possibly the drumstick.

U.S. Pat. No. 4,106,079, issued to Drury, teaches an illuminated drum stick or baton and which is constructed of a transparent material and having an internal chamber for receiving a chemiluminescent material for illuminating the drum stick or baton in a selective and display purpose.

U.S. Pat. No. 4,202,241, issued to Lucas, teaches a decorative drumstick system with different appearing inserts and which includes an elongate and internally hollowed structural body constructed of a transparent material, into which a rod can be inserted. An insertable portion is provided by an elongated shaft conforming to the configuration of the inner bore. An end cap seals off the inner bore and is screw engaged to the body. The insertable portion is disclosed as preferably including a glow-in-the-dark composition, such as a fluorescent material and which is evident through the transparent outer body construction.

Finally, U.S. Pat. No. 6,145,993, issued to Filippino, discloses an illuminated cane tip constructed of a hard transparent or translucent acrylic material. A battery, light bulb, switch and conducting wires are housed within the tip, which is in turn secured to the attached to an end of the cane by either a knot or slide means.

SUMMARY OF THE PRESENT INVENTION

The present invention is an illuminating drumstick which is an improvement over the prior art in that a biasing means is introduced to the electrical contact established between the internally located power source and the remaining electrically communicating elements of the drumstick and which prevents iterative interruptions of power flow to the illuminating element, such as a light emitting diode, situated at the tip of the drumstick during normal use of the drumstick. The improved drumstick design further provides the features of permitting the user to quickly and easily change the power supply batteries and the configuration of the butt end of the drumstick is further constructed so as to permit the user to safely strike the butt end against the drum surface.

The drumstick includes an elongated body having a hollow interior extending substantially between a tip end and open butt end. An end cap includes an enlarged head and an exteriorly threaded undercut shank portion. The end cap is threadably engaged over the open butt end of the drumstick and the shank portion includes an interiorly extending channel defined within an associated and inwardly facing end for receiving an end of an extending compression/tension spring.

The power supply is typically provided by a pair of watch batteries, or other similar lithium based batteries, each having a positive/anode terminal and a negative/cathode terminal and arranged in an end-to-end stacked fashion. A substantially elongated and cylindrical shaped housing receives the batteries through an open inserting end and is in turn axially inserted through the butt end of the drumstick. A metallic and electrically communicable stud extends from a further selected end of the housing and communicates the negative terminal of the power supply with the L.E.D., such as through a first wire extending therebetween.

The threadably engageable end cap and biasing spring provide, in combination, a circuit which is selectively openable and closable with the positive terminal of the power supply and by virtue of the end cap being threadably engaged or disengaged to selectively move the spring, by contact with a clip ring, either into or away from biasing contact with the anode terminal. The cap and spring are both constructed of a metallic composition, to thereby provide the required degree of electrical communication, as is a metallic and likewise communicable clip ring mounted about an exterior annular surface of the insertable housing, proximate its open inserting end. The batteries may again be easily replaced simply by unscrewing and removing the end cap, and associated spring, and by tilting the drumstick in a direction to cause the batteries to be dispelled from the device.

Upon threading the end cap to a closed and spring biasing position (corresponding to an "on" position) the circuit is closed with the positive terminal, by contact with the electrically communicable clip ring, and current is allowed to flow through the spring, end cap and clip ring. A second wire extends from an extending finger of the clip ring to the L.E.D. and completes the closed circuit. Rotation of the end cap in an opposite, and unscrewing, direction causes the end cap to be displaced from the anode/positive terminal of the batteries and the clip ring, and the closed circuit to be opened.

Additional variants contemplate replacing the coil spring with a suitable leaf spring or other element which provides the necessary continuous and biasing contact between the batteries and the end cap when in the threadably engaged and "on" position. A spring biasing or wave washer may be incorporated between the end cap and the clip to maintain contact therebetween in a screwed/tightened/closed position of the circuit. Also, a transparent or translucent covering material may be applied over the L.E.D. element, such as a vinyl or durable plasticized material, and which may be color impregnated to give off a desired color during use of the drumstick. It is also contemplated that the L.E.D. elements may be interchangeable at the tip end of the drumstick, such as be first removing the associated covering material, and replacing with a substitute L.E.D. emitting light in a different color of the overall color spectrum.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figures 1, 1A, 1B:
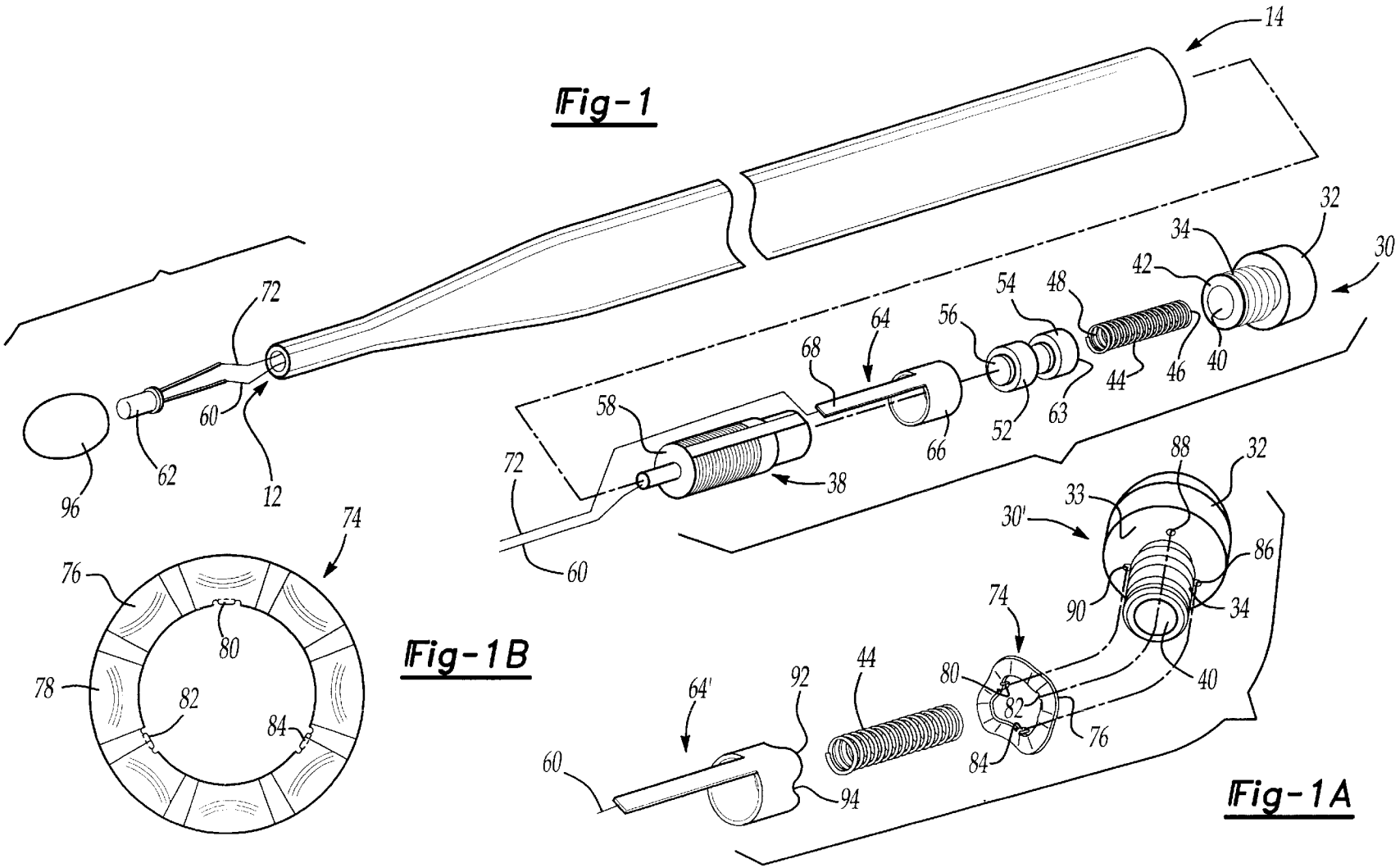
FIG. 1 is an exploded view of the improved and illuminating drumstick according to the present invention.
FIG. 1A is a sectional view of an alternate configuration incorporating a spring-biasing washer for maintaining engaging contact between the end cap and spring clip according to the present invention.
FIG. 1B is an enlarged sectional view of the washer illustrated in FIG. 1A.

Referring now to FIG. 1, an improved and illuminating drumstick is illustrated at 10 according to a preferred embodiment of the present invention. As previously explained, the illuminating drumstick is an improvement over the prior art in that a biasing means is introduced to the electrical contact established between the internally located power source and the remaining electrically communicating elements of the drumstick and which prevents iterative interruptions of power flow to the illuminating element during normal use (gyrations) of the drumstick. The improved drumstick design further provides the features of permitting the user to quickly and easily change the power supply batteries and the configuration of the butt end of the drumstick is further constructed so as to permit the user to safely strike the butt end against the drum surface and/or percussion surface.

Figures 2, 3, 4:
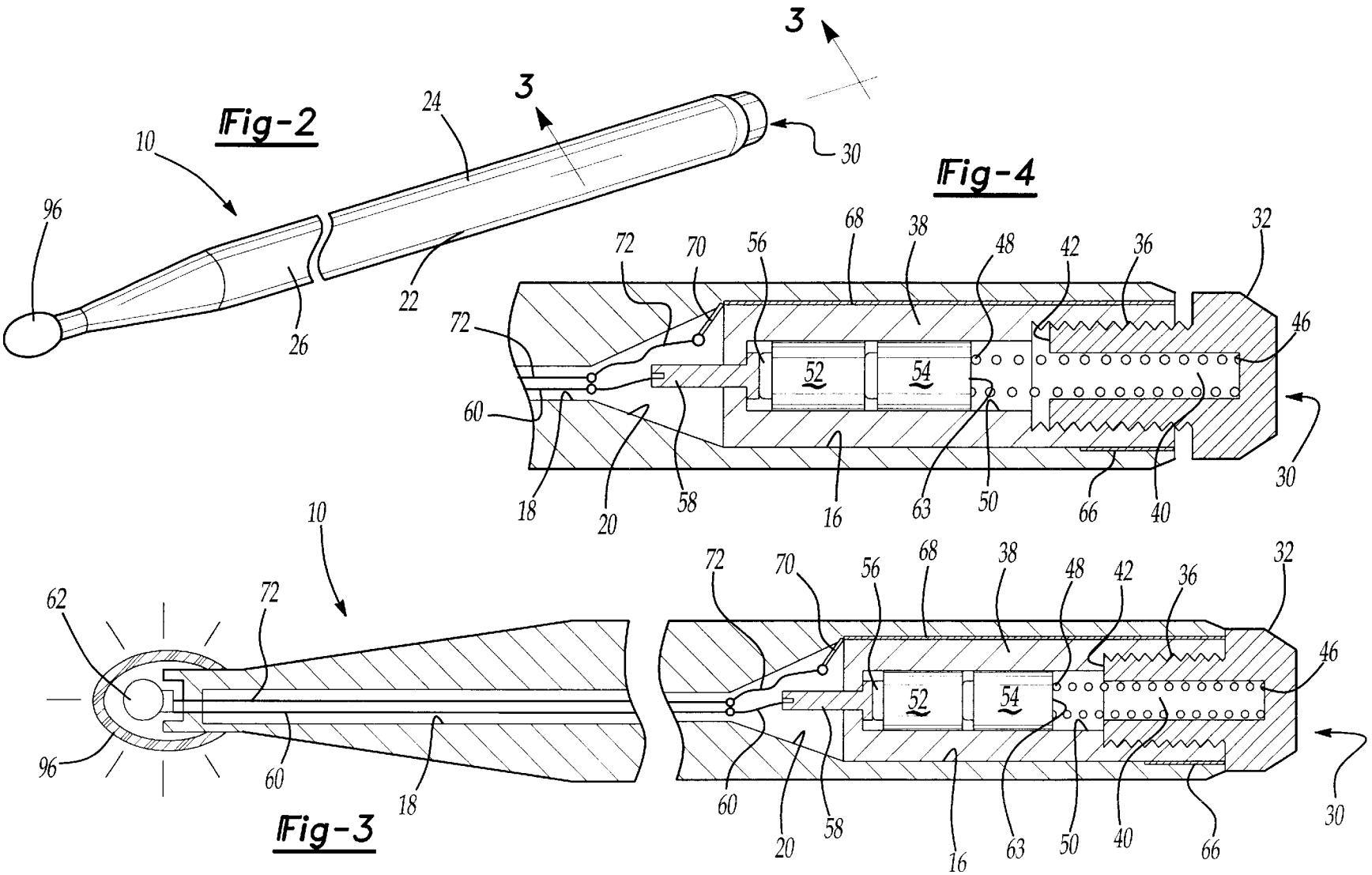
FIG. 2 is a perspective view, in partially reduced fashion, of the illuminating drumstick also illustrated in FIG. 1.
FIG. 3 is a cutaway view taken along line 3—3 of FIG. 2 and showing the power supply and circuit in a first threadably engaged and "on" position and in which a continuous and spring biasing contact is established between the threadably engageable end cap and a positive terminal of the power supply.
FIG. 4 is an enlarged sectional view in cutaway, similar to that shown in FIG. 3, and further illustrating the end cap threadably disengaged to an "off" position in which the spring biasing member is displaced from the positive terminal of the power supply.

Referring again to FIG. 1, the drumstick 10 includes an elongated body having a hollow and axially extending interior extending substantially between a tip end 12 and an open butt end 14. Referring further to FIGS. 2 and 3, the hollow extending interior is shown in cutaway and typically includes an enlarged inner annular surface 16 corresponding to a rear or handle leading to the butt end 14, as well as a substantially narrowed interior/annular surface 18 extending proximate the tip end 12 and interconnected to the enlarged annular surface 16 by an angled and intermediate connecting surface 20.

The configuration of the hollow extending interior (annular surfaces 16, 18 and 20) is arranged to incorporate the necessary components of the device, as will be subsequently described, while at the same time maintaining the necessary structural integrity of the drumstick in use. It is also contemplated that, while the drumstick 10 can be constructed of wood, it is also envisioned that other inorganic and composite materials can be employed without departing from the scope of the invention. It is also envisioned that it is possible for the drumstick 10 to be drilled or bored in a manner necessary to create the necessary inner and annular extending surfaces 16, 18 and 20. However, the preferred variant of the invention contemplates the drumstick being provided as first and second separable halves, such as generally represented at 22 and 24 in the perspective of FIG. 2 and separable along phantom line 26 extending axially therebetween. In this fashion, the separable halves 22 and 24 may be easily assembled (upon insertion of the necessary operating components) through the application of a wood based adhesive or the like.

Referring again to FIG. 1, a threadably engageable end cap 30, typically constructed of a metallic and electrically conductive material such as brass, is provided and includes an enlarged head 32 and an exteriorly threaded and undercut shank portion 34. The end cap 30 is threadably engaged over the open butt end 14 of the drumstick 10 (by interengaging with opposing and interiorly extending threads 36 formed in a substantially elongated and cylindrical shaped housing 38 which is slidably insertable within the selected annular surface 16 defining part of the hollowed interior of the drumstick 10. The exteriorly threaded shank portion 34 of the end cap 30 includes an interiorly extending channel defined 40 defined within its inwardly facing end face 42 and extending in a direction towards the enlarged head 32.

A biasing member is provided and, in the preferred embodiment, includes an elongated and tensioning/compressing coil spring 44. A first end 46 of the coil spring 44 is received within the interiorly extending channel 40 defined in the end cap 30 and an opposite and second end 48 extends in a direction towards the cylindrical shaped housing 38. The housing 38 is interiorly hollowed, as defined by inner annular surface 50 and receives, in axially inserting fashion, a portable power supply. The power supply is typically provided by a pair of watch batteries 52 and 54, or other similar lithium based batteries, each having a positive/anode terminal and a negative/cathode terminal and arranged in an end-to-end stacked fashion. In order to load the drumstick 10, the substantially elongated and cylindrical shaped housing 38 receives the batteries 52 and 54 through the open inserting end, defined by the inner annular surface 50, and is in turn axially inserted through the butt end 14.

A cathode, or negatively charged terminal, 56 of the forward-most located battery 52 electrically communicates with a metallic and electrically communicable stud 58 (typically brass or aluminum) extending from a forward end of the housing 38. A first wire 60 extends from the stud 58 and communicates at an opposite end with an illuminating element 62, such as including a light-emitting diode (or L.E.D.) in the preferred variant and as will be further described in more detail. Although not shown, a current limiting resistor may be provided in communication with the circuit at the stud 58 and properly biases the input requirements of the LED unit, such as by stepping down input current to the LED, so that the unit will illuminate properly with minimal heat emission.

The threadably engageable end cap 30 and biasing spring 44 provide, in combination, a circuit which is selectively openable and closable with the positive/anode terminal of the power supply and defined as being a biasing connection established between the second extending end 48 of the spring 44 and abutting positive terminal 63 defined on the rearward-most battery 54. The end cap 30 is threadably engaged or disengaged to selectively move in and out of contact with the clip ring 64, either into or away from biasing contact with the anode terminal 63 of rearward most battery 54, as will be subsequently described in more detail. The cap 30 and spring 44 are again both constructed of a metallic composition, to thereby provide the required degree of electrical communication through the clip ring 64 and to the LED element. In all positions, the spring 44 maintains some degree of contact with the extending end 48 (anode 63) of battery 54.

The metallic and electrically communicable clip ring 64 (again typically brass in construction) is provided and includes an annular sleeve 66 and an axially extending finger 68. The sleeve 66 is mounted about an exterior annular surface of the insertable housing 38, proximate its open inserting end 50 and extends in a direction towards the opposite end where the conductive stud 58 is mounted. The finger 68 extends from a connecting location with the annular sleeve 66 and terminates at a forward-most location 70 proximate the stud 58 and (see FIGS. 3 and 4) within the open interior of the drumstick 10. Extending from end location 70 is a second wire 72 which communicates the positive terminal with the illuminating element 62.

Upon threading the end cap 30 to a tightened/closed and spring biasing position (corresponding to an "on" position) the circuit is closed with the spring end 48 (by contact of end cap 30 with clip ring 64) biasing against the positive terminal 63 and permitting current to flow through the spring 44, end cap 30, clip ring 64 and second wire 72 extending to the illuminating element 62. The negative terminal connection extending from cathode 56 (of battery 52), stud 58, and first wire 60 extending to illuminating element 62 is fixed as a closed component of the circuit and, upon engagement of the biasing spring 44 at the anode terminal, completes the closed circuit. Subsequent rotation of the end cap 30 in an opposite, and unscrewing, direction causes the spring 44 and extending spring end 48 to decompress from the anode/positive terminal 63 of the rearward most situated battery 54 and the closed circuit to be opened upon disengagement from clip ring 64, to disconnect current to the illuminating element 52.

Although the preferred embodiment contemplates utilization of the coil spring 44, it is understood that the positive terminal connection contemplates utilizing a suitable leaf spring or other element which may effectively bias the anode terminal of the batteries at one end and the end screw 30 at the other and which provides the necessary continuous and biasing contact between the batteries 52 and 54 and the end cap 30 when in the threadably engaged and "on" position. Referring to FIG. 1A, an alternate reconfiguration contemplates provision of a washer 74 provided between end cap 30' and clip ring 64'. The washer 74 (referring also to FIG. 1B) is undulating or waved in cross section (as illustrated by peaks 76 and valleys 78) and further includes a plurality of three tabs 80, 82 and 84 extending from the washer 74.

The end cap 30' includes an end shoulder 33, within which is configured holes 86, 88 and 90 which align and seat the three associated and projecting tabs 80, 82 and 84 and to mount the spring washer 74 in place. An opposing end surface of the clip ring 64' (defined by undulating peaks 92 and valleys 94, in FIG. 1A) align with the associated peaks 76 and valleys 78 of the washer 74 upon tightening of end cap 30'. In this position, the end cap 30' will not threadably disengage from the clip 64' under extreme vibration.

As previously described, the ability to maintain a continuous and biasing contact with the power source is critical in preventing intermittent shorts and openings in the circuits and to which the prior art illuminated drumstick devices are suspect. It is also contemplated that the direction of the power supply batteries 52 and 54 can be reversed and so that the closed circuit could be accomplished at the cathode, rather than anode, terminal and without departing from the intended scope of the invention. However, reconfiguration of the LED, or suitable lighting element, will have to be considered in any redesign of the terminal connections as previously described herein.

The illuminating element 62, as previously described, is preferably a light emitting diode (L.E.D.) for the purpose that such a diode provides the greatest degree of illumination for a given current and voltage input, and at the same time has been found to be the most durable and break-resistant lighting component. For these reasons, tungsten based bulbs and the like are poorly suited as they would tend to break relatively easily due to shock and vibration in application.

A covering 96 is applied over the light emitting diode 62. The covering 96 is typically constructed of a material selected from the group including a vinyl, a durable plastic and mixed polymer composition and is further shaped in an generally oval fashion with a hollowed and open interior so as to provide a durable and somewhat flexibly unit which is configured to be resiliently applied over the diode 62. In one preferred variant, the covering 96 is constructed of a transparent material and cooperates with a selected one of a plurality of additional and interchangeable light emitting diodes (not shown), each constructed substantially identically to the diode represented by illuminating element 62 and installable to emit light according to a selected color. It is also contemplated that the L.E.D. elements may be interchangeable at the tip end of the drumstick, such as be first removing the associated covering material, and replacing with a substitute L.E.D. emitting light in a different color of the overall color spectrum.

In a further preferred variant, the covering 96 is constructed of a substantially translucent covering applied over the illuminating element/light emitting diode 62. A plurality of interchangeable translucent coverings (each again not shown but constructed substantially identically to the covering 96 illustrated) may be provided and each of which is selected according to one of a plurality of differing color impregnations and so as to emit a given coloring in similar fashion as accomplished with the differing colored L.E.D. elements in the prior described variant.

Having described my invention, it will become apparent that it discloses an improved construction for an illuminated drumstick which is an improvement over the prior art in that it ensures continuous biasing contact established between the power supply and an associated closed circuit extending through an L.E.D. or other suitable lighting element. Additional preferred embodiments will become apparent to those skilled in the art to which it pertains and without deviating from the scope of the appended claims.

I claim:

1. An illuminating drumstick, comprising:

an elongated body having a hollowed interior extending substantially between a tip end and an open butt end, a threadably engageable end cap securing over said butt end;

a power supply contained within said hollowed interior, said power supply including at least one battery having a positive terminal and a negative terminal;

an illuminating element arranged at said tip end and communicable with said positive and negative terminals of said power supply, said illuminating element further comprising a light emitting diode, a first wire extending from said diode to said negative terminal and a second wire extending from said diode to said positive terminal;

an on/off circuit activated by said end cap and selectively opening and closing an electrical connection to at least one of said positive and negative terminals; and said circuit further comprising a continuously biasing spring and an electrically communicable clip ring urged by said end cap in a first threaded direction against said at least one terminal and in a first on position, said spring disengaging from said terminal in a second off position upon rotation of said end cap in an opposite and unthreaded direction.

2. An illuminating drumstick, comprising:

an elongated body having a hollowed interior extending substantially between a tip end and a butt end of said body;

a power supply contained within said hollowed interior, said power supply including a positive terminal and a negative terminal;

a substantially elongated and cylindrical shaped housing which is open at a selected end for receiving, in inserting fashion, said power supply, said housing axially inserting within said butt end of said elongated body;

an illuminating element arranged at said tip end and communicable with said positive and negative terminals of said power supply;

a first wire extending from said illuminating element to said negative terminal and a second wire extending from said illuminating element to said positive terminal;

a metallic and electrically communicable stud extending from a further selected end of said housing opposite said open end, said stud communicating said negative terminal of said power supply to said first wire;

an on/off circuit activated from said butt end and selectively opening and closing an electrical connection to at least one of said positive and negative terminals; and said circuit further comprising a continuous biasing means applied from said butt end and against said at least one terminal in a first on position, said biasing means disengaging from said terminal in a second off position.

3. The illuminating drumstick as described in claim 2, further comprising an end cap threadably engaging over said butt end, said biasing means being sandwiched between said end cap at a first end and said terminal of said power supply at a second end, rotation of said end cap in a selected direction achieving said on and off positions of said circuit.

4. The illuminating drumstick as described in claim 3, said biasing means further comprising a coil spring having a first end engaging within an interiorly extending channel defined within an inwardly facing end of said end cap, a second end of said spring biasingly engaging said positive terminal of said power supply in said on position.

5. The illuminating drumstick as described in claim 2, further comprising a metallic and electrically communicable clip ring having an annular sleeve and an axially extending finger, said annular sleeve encircling said housing proximate said open end and electrically communicating said positive terminal of said power supply through said continuous biasing means and said butt end in said on position, said axially extending finger further communicating said positive terminal to said second wire.

6. The illuminating drumstick as described in claim 2, said illuminating element further comprising a light emitting diode.

7. The illuminating drumstick as described in claim 6, further comprising a substantially transparent covering applied over said light emitting diode.

8. The illuminating drumstick as described in claim 7, further comprising a plurality of interchangeable light emitting diodes, each emitting light according to a selected color.

9. The illuminating drumstick as described in claim 6, further comprising a substantially translucent covering applied over said light emitting diode.

10. The illuminating drumstick as described in claim 9, further comprising a plurality of interchangeable translucent coverings, each of which is selected according to one of a plurality of differing color impregnations.

11. The illuminating drumstick as described in claim 2, said power supply further comprising at least one battery.

12. The illuminating drumstick as described in claim 11, further comprising a plurality of batteries arranged in end-to-end stacked fashion.

13. An illuminating drumstick, comprising:

an elongated body having a hollowed interior extending substantially between a tip end and a butt end of said body;

a power supply contained within said hollowed interior, said power supply including a positive terminal and a negative terminal;

a substantially elongated and cylindrical shaped housing which is open at a selected end for receiving, in inserting fashion, said power supply, said housing axially inserting within said butt end of said elongated body;

an illuminating element arranged at said tip end and communicable with said positive and negative terminals of said power supply;

a first wire extending from said illuminating element to said negative terminal and a second wire extending from said illuminating element to said positive terminal;

a metallic and electrically communicable clip ring having an annular sleeve and an axially extending finger, said annular sleeve encircling said housing proximate said open end and electrically communicating said positive terminal of said power supply through said continuous biasing means and said butt end in said on position, said axially extending finger further communicating said positive terminal to said second wire;

an on/off circuit activated from said butt end and selectively opening and closing an electrical connection to at least one of said positive and negative terminals; and said circuit further comprising a continuous biasing means applied from said butt end and against said at least one terminal in a first on position, said biasing means disengaging from said terminal in a second off position.

14. The illuminated drumstick as described in claim 13, further comprising a spring biasing washer disposed between said end cap and said clip ring to maintain threaded engagement therebetween.

15. The illuminated drumstick as described in claim 14, further comprising a plurality of tabs extending from said washer, a plurality of holes defined in an end shoulder of said end cap receiving said tabs to fixedly position said washer.

16. The illuminated drumstick as described in claim 15, further comprising an undulating surface in said clip ring which opposes and engages with a likewise undulating surface defined in said washer and upon tightening of said end cap.

17. An illuminating drumstick, comprising:

an elongated body having a hollowed interior extending substantially between a tip end and a butt end of said body;

a power supply contained within said hollowed interior, said power supply including a positive terminal and a negative terminal;

an illuminating element arranged at said tip end and communicable with said positive and negative terminals of said power supply, said illuminating element further comprising a plurality of light emitting diodes each emitting light according to a selected color, a substantially transparent covering applied over each of said light emitting diodes;

an on/off circuit activated from said butt end and selectively opening and closing an electrical connection to at least one of said positive and negative terminals; and said circuit further comprising a continuous biasing means applied from said butt end and against said at least one terminal in a first on position, said biasing means disengaging from said terminal in a second off position.

18. An illuminating drumstick, comprising:

an elongated body having a hollowed interior extending substantially between a tip end and a butt end of said body;

a power supply contained within said hollowed interior, said power supply including a positive terminal and a negative terminal;

an illuminating element arranged at said tip end and communicable with said positive and negative terminals of said power supply, said illuminating element further comprising a light emitting diode, a plurality of substantially translucent coverings selectively capable of being applied over said light emitting diode, each of said covering being selected according to one of a plurality of differing color impregnations;

an on/off circuit activated from said butt end and selectively opening and closing an electrical connection to at least one of said positive and negative terminals; and said circuit further comprising a continuous biasing means applied from said butt end and against said at least one terminal in a first on position, said biasing means disengaging from said terminal in a second off position.

19. The illuminating drumstick as described in claim 18, further comprising said translucent covering being constructed of a material selected from the group consisting of a vinyl, a durable plastic and mixed polymer composition.

* * * * *